US006059046A

United States Patent [19]

Lowry

[11] Patent Number: 6,059,046

[45] Date of Patent: May 9, 2000

[54] LOW PRESSURE CARBON DIOXIDE FIRE PROTECTION SYSTEM FOR SEMICONDUCTOR FABRICATION FACILITY

[75] Inventor: James E. Lowry, Boardman, Ohio

[73] Assignee: Grunau Company, Inc., Oak Creek, Wis.

[21] Appl. No.: 09/035,562

[22] Filed: Mar. 5, 1998

[51] Int. Cl.[7] ..... A62C 37/10

[52] U.S. Cl. ..... 169/61

[58] Field of Search ..... 169/54, 59–61

[56] References Cited

U.S. PATENT DOCUMENTS

| | | | |
|---|---|---|---|
| 2,341,437 | 2/1944 | Getz | 169/2 |
| 3,762,477 | 10/1973 | Mobley, Sr. | 169/2 R |
| 3,825,766 | 7/1974 | Conner et al. | 169/61 X |
| 3,865,192 | 2/1975 | Dunphy | 169/61 |
| 3,866,687 | 2/1975 | Banner | 169/61 |
| 3,917,001 | 11/1975 | Davis et al. | 169/61 |
| 3,993,138 | 11/1976 | Stevens et al. | 169/61 |
| 4,013,128 | 3/1977 | Davis | 169/61 |
| 4,305,469 | 12/1981 | Morrisette | 169/61 |
| 4,580,638 | 4/1986 | Jones et al. | 169/49 |
| 4,688,644 | 8/1987 | Hemming | 169/61 |
| 4,964,471 | 10/1990 | Michalik et al. | 169/57 |
| 5,154,237 | 10/1992 | Cooper | 169/54 |
| 5,163,517 | 11/1992 | Kozai et al. | 169/60 |
| 5,351,760 | 10/1994 | Tabor | 169/59 X |
| 5,649,598 | 7/1997 | MacDonald, III | 169/54 |

OTHER PUBLICATIONS

"Cardox® Low Pressure Carbon Dioxide Fire Extinguishing Systems", Chemetron Fire Systems, Brochure No. 7–000–0140, 1987.

"A World of Protection", Chemetron Fire Systems, Brochure No. 7.5M5, 1997.

*Primary Examiner*—Kevin Weldon

*Attorney, Agent, or Firm*—Andrus, Sceales, Starke & Sawall

[57] ABSTRACT

A fire protection system for a clean room semiconductor fabrication facility involves the use of a low pressure carbon dioxide source and a discharge system to extinguish fires detected in or near the tools. Each tool is plumbed with dedicated carbon dioxide suppression agent discharge plumbing. The system individually monitors each tool for fire, preferably using infrared radiation sensors and linear heat detection cable. A remote control panel responsive to the fire detectors controls the discharge of carbon dioxide suppression agent unless there is operator intervention. A user interface at or near the respective tool includes various manually actuated controls to override the automatic operation of the fire protection system, and therefore allow a supervisor to eliminate or at least minimize the amount of clean up, repairs and downtime associated with the discharge of carbon dioxide suppression agent in case of a false alarm. The components of the fire protection system (e.g. detectors, plumbing, discharge nozzles) are especially protected against chemical corrosion not only to maintain the performance of the fire protection system over time, but also to avoid the generation of particulates that could possibly pollute the clean room environment and adversely affect the semiconductor manufacturing environment.

11 Claims, 8 Drawing Sheets

LOW PRESSURE CARBON DIOXIDE FIRE PROTECTION SYSTEM FOR SEMICONDUCTOR FABRICATION FACILITY

FIELD OF THE INVENTION

The invention is an electronically controlled fire detection and suppression system. In particular, the invention involves the use of a low pressure carbon dioxide discharge system to extinguish fires detected in or near semiconductor fabrication tools located in "clean room" facilities.

BACKGROUND OF THE INVENTION

Semiconductor fabrication facilities normally include several fabrication tools located in a clean room. The fabrication tools robotically implement the sophisticated photolithographic process which involves dipping semiconductor silicone substrates in chemical baths. High efficiency air filtration systems are used to reduce particulates in the clean room that may contaminate the processes. In addition, some of the fabrication tools are provided with ultra high efficiency filtration units positioned over critical process areas to further reduce the potential of contamination. The chemical vapors can be extremely corrosive. Most if not all of the tools are equipped with fume exhaust systems which exhaust the chemical vapors from the tool to fume conditioning equipment for the facility.

The potential for fire exists in semiconductor fabrication tools not only due to the combustible nature of semiconductor materials, but also because of the materials and design of the fabrication tools. For example, most semiconductor fabrication tools include electrical heating elements or other heat producing equipment that is located in close proximity to plastic composite materials. Therefore, upon failure of a heating element or some other type of failure, the plastic composite materials of the tool structure may melt, thus generating combustible vapors that support propagation of fire to adjacent materials. This type of burning of plastic composite materials generally produces large particulate smoke which is harmful to the affected tool and also to adjacent processes in the clean room fabrication facility.

While clean room semiconductor fabrication facilities are normally equipped with conventional fire suppression systems such as sprinklers, it is normally desirable to equip the individual tools with dedicated fire detection and suppression equipment. Individual fire detection and suppression systems are used because it is desirable to avoid the initiation of sprinkler discharge from the facility fire suppression system into the clean room which is likely to damage or at least contaminate several if not all of the individual tools. One type of fire detection and suppression system used on individual semiconductor fabrication tools uses high pressure carbon dioxide as a fire suppression agent. When a fire is detected in or near the tool, these systems release carbon dioxide into the individual tool from high pressure carbon dioxide canisters. Once the discharge cycle is initiated, the system must discharge completely due to the nature of high pressure carbon dioxide discharge systems.

Obviously, it is important that the fire protection system for the clean room and for the individual fabrication tools reliably detect fires, and suppress detected fires efficiently in order to reduce the likelihood of damage to the surrounding area including inter-exposed semiconductor fabrication tools. On the other hand, the discharge of fire suppression agent in response to a false alarm can be extremely costly for the facility. The discharge of suppression agent can cause substantial harm and contamination to the individual fabrication tools, as well as lead to significant downtime for clean-up. In many cases, the cost of downtime associated with the clean up after a false alarm is substantially greater than the actual cost of clean-up and repairs.

One of the main drawbacks of using high pressure carbon dioxide fire suppression systems on individual tools is that the discharge of suppression agent cannot be terminated once the discharge cycle begins. Thus, even in a false alarm situation, high pressure carbon dioxide fire suppression systems discharge normally creates significant harm and contamination to the tool and also leads to significant downtime for the tool and/or facility.

BRIEF SUMMARY OF THE INVENTION

The invention is a low pressure carbon dioxide fire protection system for use in a clean room semiconductor fabrication facility. The system has fire detectors that individually monitor semiconductor fabrication tools within the clean room. The system includes discharge plumbing dedicated to each individual tool for the purpose of discharging carbon dioxide suppression agent into or near the tool when a fire is detected within or near the tool. Several of the tools in the facility, if not all, are connected to a common supply source of low pressure carbon dioxide (e.g. a refrigerated tank containing carbon dioxide liquid in which the vapor pressure in the tank is normally maintained between 285–315 psig) through a distribution system including piping and flow control valves. The flow control valves are operated automatically in response to signals from the fire detectors to initiate carbon dioxide discharge within or near a respective tool on the basis of a preselected timing sequence. However, a manual control station (i.e., a user interface) is provided at or near the tool which allows for operator intervention to override the preselected timing sequence for valve operation. The use of low pressure carbon dioxide as the fire suppression agent (in contrast to high pressure carbon dioxide) allows the use of repositionable valves to control discharge, and therefore facilitates manual operator intervention if necessary.

In the preferred system, the operator can either delay the initiation of carbon dioxide discharge beyond the ordinary time delay prior to carbon dioxide discharge that is provided to allow for evacuation of the facility after sounding of the alarm. Alternatively, an operator can actuate an emergency disable switch that closes the necessary flow control valve for the respective tool to disallow or terminate further carbon dioxide discharge. In this manner, a facility supervisor has the capability of immediately terminating carbon dioxide discharge in case of a false alarm. Thus, the supervisor can eliminate, or at least minimize, the amount of clean-up, repairs and downtime associated with the discharge of carbon dioxide suppression agent into or near the tool.

In the preferred system, each semiconductor fabrication tool is equipped with one or more fire protection subsystems. Each subsystem is controlled automatically by an electronic control unit that is located remote from the tool. The electronic control unit provides electrical power to the fire detectors and the alarms located at the tool, and also controls the automatic operation of the carbon dioxide flow control valves in response to one or more alarm signals from the fire detectors for the subsystem. The electronic control unit also preferably includes data logging and display capabilities. Each fire protection subsystem includes a plurality of fire detectors, preferably several optical (e.g. infrared radiation)

detectors viewing certain areas within or near the tool, and linear heat actuated cable monitoring enclosed areas in the tool. For system reliability, it is important that the detectors be protected from corrosion in regions of the tool that the detectors and/or wiring is exposed to chemically corrosive environments. It is also important to prevent corrosion because corrosion can compromise the performance and life of the fire protection system, but also because corrosion can contaminate the process in the tool. The discharge plumbing for a particular subsystem includes discharge piping that is routed through the tool, a plurality of discharge nozzles mounted to the discharge piping and a selector flow control valve. Preferably, the selector flow control valve is located remotely from the tool. It is also important that discharge piping and nozzles located in chemically corrosive environments be protected from corrosion. For instance, nozzles are preferably fitted with corrosion resistant (e.g. Teflon) caps. Low pressure carbon dioxide distribution plumbing distributes low pressure carbon dioxide from the refrigerated tank to the respective selector flow control valves for each subsystem.

In a facility having many tools, the distribution plumbing from the refrigerated tank of liquid carbon dioxide preferably includes a tank discharge header that is mounted to the tank and which has a plurality of outlets. Each outlet is equipped with a master flow control valve that controls the flow of carbon dioxide suppression agent from the tank through the respective outlet to several selector flow control valves. The master flow control valves and the selector flow control valves in the system are opened and closed by electrically controlled actuators. Preferably, a vapor pilot line from the carbon dioxide tank provides actuation pressure for the actuators.

In response to a fire detected within or near a respective tool, the electronic control unit initiates the preselected timing sequence which includes, as previously mentioned, a suitable time delay for evacuation prior to opening the appropriate master flow control valve and selector flow control valve for the respective subsystem. Upon expiration of the evacuation time delay, the electronic control unit transmits signals to instruct the respective actuators to open the associated master flow control valve and selector flow control valve. Unless there is operator intervention, carbon dioxide suppression agent will discharge through the opened master and selector flow control valves and through the associated discharge plumbing for the tool for a preselected discharge time period (e.g. 45 seconds). At the end of the discharge time period, the electronic control unit instructs the respective actuators to close the associated master unit and selector flow control valves.

As mentioned previously, the user interface facilitates operator intervention in the event that it is desirable to prevent unnecessary discharge after a false alarm. Informed decision making by a supervisor manually intervening to delay or disable the discharge of carbon dioxide fire suppressant is promoted by providing the manual control station (i.e.,the user interface) at or near the respective semiconductor fabrication tool.

Other features and advantages of the invention may be apparent to those skilled in the art upon inspecting the following drawings and description thereof.

DETAILED DESCRIPTION OF THE DRAWINGS

Figure 1:
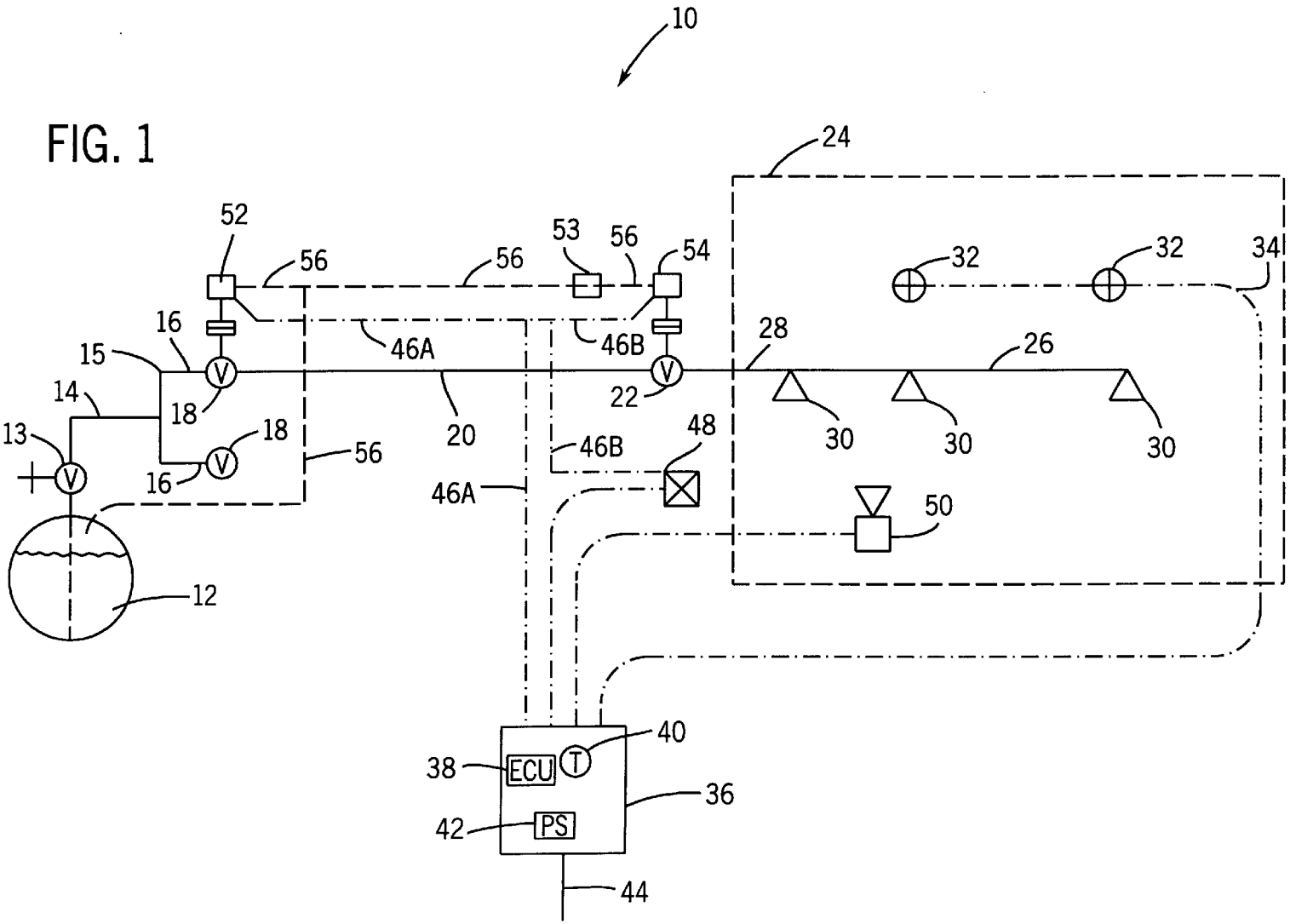
FIG. 1 is a schematic drawing illustrating a fire detection and low pressure carbon dioxide fire suppression system for a clean room semiconductor fabrication facility in accordance with the invention.

FIG. 1 schematically illustrates a low pressure carbon dioxide fire protection system 10 in accordance with the preferred embodiment of the invention. The low pressure carbon dioxide fire protection system 10 includes a source 12 of low pressure carbon dioxide which is the fire suppression agent for the system. The source 12 of low pressure carbon dioxide is preferably a refrigerated tank containing carbon dioxide liquid in which the vapor pressure in the tank is normally maintained at approximately 285–315 psig. An isolation valve 13 is provided at the tank 12 in line 14. The isolation valve 13 is normally open when the system 10 is in operation, and is provided to facilitate maintenance of the system 10. Line 14 from the tank 12 leads to a tank discharge header 15. The tank discharge header 15 is a manifold having a plurality of outlets 16. A master flow control valve 18 is provided on each outlet 16 of the tank discharge header 15 to control flow through the respective outlet 16.

Figure 2:
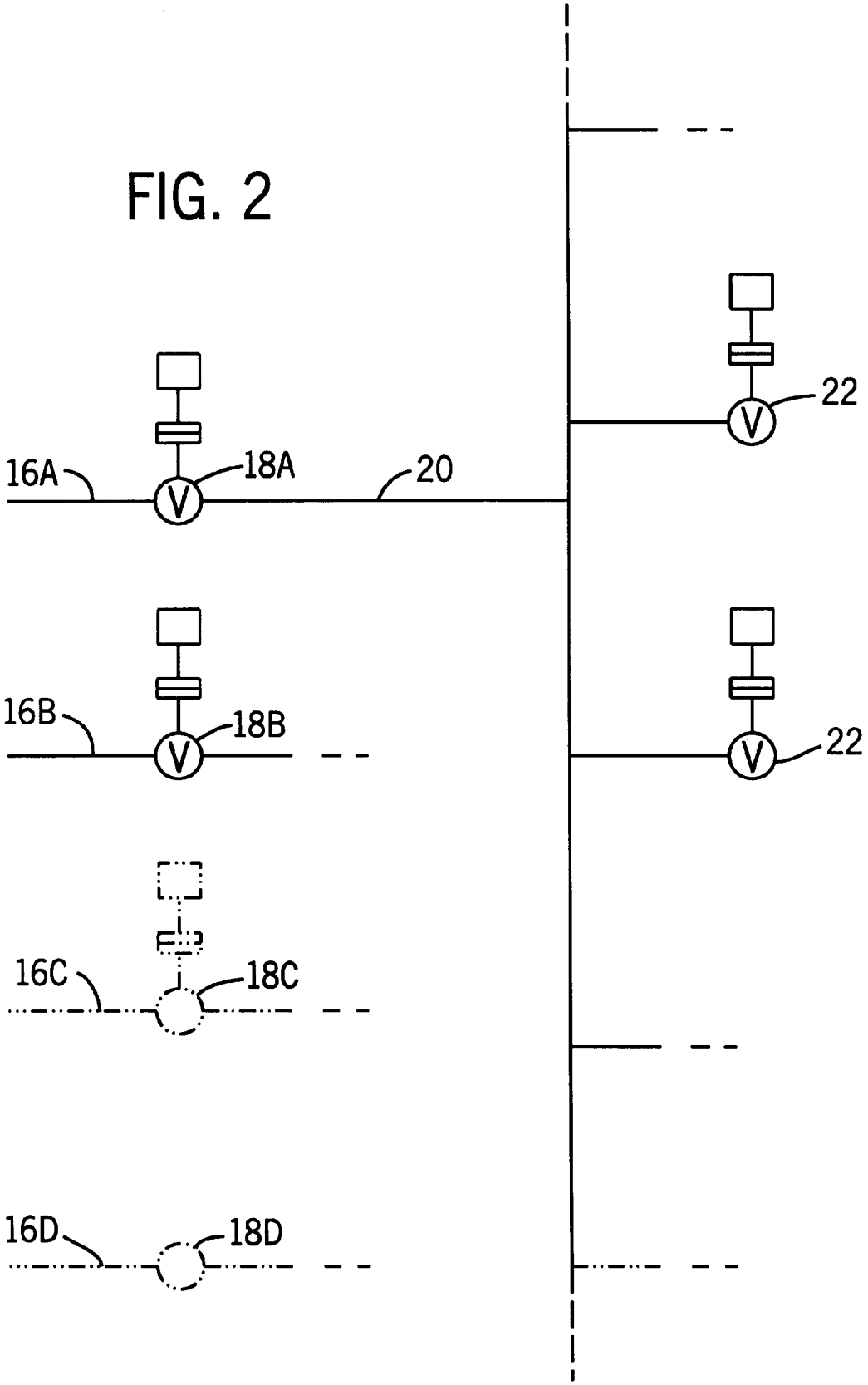
FIG. 2 is a schematic drawing illustrating distribution plumbing for the system shown in FIG. 1.

Referring now to FIG. 2, each master flow control valve 18*a*, 118*b*, 18*c*, 118*d* is responsible for controlling the flow of low pressure carbon dioxide suppression agent through the respective outlet 16*a*, 16*b*, 16*c*, 16*d* of the tank discharge header 15 into low pressure carbon dioxide distribution plumbing 20 for one or more fire protection subsystems dedicated to individual semiconductor fabrication tools in the clean room facility. In particular, the low pressure carbon dioxide distribution plumbing 20 will typically include sufficient piping to provide low pressure carbon dioxide fire suppression gas from the respective master flow control valve, e.g. 18*a*, to a plurality of selector flow control valves 22. The selector flow control valves 22 control the flow of low pressure carbon dioxide suppression agent to an associated fire protection subsystem 24 for the respective tool as shown schematically in FIG. 1. Still referring to FIG. 2, it may be desirable to provide several master flow control valves 18*a*, 18*b*, 18*c*, 18*d*, near the refrigerated tank 12 in order to minimize the amount of low pressure carbon dioxide suppression agent that is required to fill the distribution piping 20 between the master flow control valves 18*a*, 18*b*, 18*c*, 18*d* and the respective selector flow control valves 22. In accordance with the invention, the system 10 may include any number of master flow control valves 18 depending on the requirements for the clean room facility.

Referring again to FIG. 1, each fire protection subsystem 24 includes low pressure carbon dioxide discharge plumbing 26. The low pressure discharge plumbing 26 for each subsystem 24 consists of discharge piping 28 routed through the semiconductor fabrication tool, and a plurality of discharge nozzles 30 which are mounted to the discharge piping 28. The selector flow control valve 22 controls the flow of low pressure carbon dioxide to the discharge piping 28. Fire detectors 32 are located in or near the tool. Each fire detector 32 outputs an alarm signal, line 34, that is transmitted to a control panel 36. The control panel 36 is preferably located in a region remote from the tool. The control panel 36 includes an electronic control unit 38, a timer 40, and a back-up power supply 42. The control panel 36 controls automatic actuation of the selector flow control valve 22 and the associated master flow control valve 18 in response to one or more alarm signals from the detector 32, shown schematically by line 46. The control panel 36 receives external power, line 44, and outputs electrical power to the detectors 32 for the subsystem 24.

A user interface 48 is located at or near the tool associated with the subsystem 24. In accordance with the invention, the user interface 48 can be used for manual initiation of a discharge cycle, or can be used to abort or shut-off an automatically initiated discharge cycle is as described in more detail with respect to FIGS. 5, 11 and 12. Each subsystem 24 also includes an audio and/or visual alarm 50 which is located at or near the protected area.

The master flow control valves 18 and the selector valves 22 are operated by mechanical actuators 52, 54. Preferably, the actuators 52, 54 are connected to a vapor pilot line 56 communicating with the refrigerated carbon dioxide tank 12. The vapor pressure within the refrigerated carbon dioxide tank 12 thus provides actuation force to mechanically move the valves 52, 54 from the closed position to the open position after the electronic control unit 38 in the control panel 36 instructs the valves 52, 54 to open by transmitting a control signal through line 46.

Briefly describing the operation of the system 10 as shown schematically in FIGS. 1 and 2, the control panel 36 operates the alarm 50 and timing functions as required by the system operating parameters in response to an alarm signal, line 34, from one or more of the fire detectors 32. If there is no user intervention via the user interface 48, the control panel 36 initiates a carbon dioxide suppression agent discharge cycle. Alternatively, the suppression agent discharge cycle can be initiated manually at the user interface 48. The suppression agent discharge cycle will normally initiate after an evacuation time period, for example, approximately 30–45 seconds, which is a preselected time period that enables personnel in the area to evacuate the facility after the alarm 50 has sounded. Upon the expiration of the evacuation time period, the flow control valves 18, 22 are opened automatically in response to control signals transmitted through lines 46 to the respective actuators 52, 54. The valves 18, 22 remain open for a preselected discharge time period that is sufficient to permit the desired quantity of carbon dioxide suppression agent to be discharged through the respective subsystem discharge nozzles 30 into the area of application (e.g. approximately 45–60 seconds depending on the needs of the system 10). It should be noted that the carbon dioxide suppression agent is self-pressurizing within the tank 12, and the vapor pressure created provides the driving force to convey the carbon dioxide suppression agent through the pipelines 14, 15, 16, 20 and 28 to the respective discharge nozzles 30. The sizes of the pipelines are selected to deliver the required quantity of carbon dioxide suppression agents to the area of application at the required pressure and volume. The quantity of suppression agent required within a preselected timeframe, i.e. the suppression agent discharge time period, to achieve fire suppression for the area of application is determined by published codes and standards and by the operating conditions at the tool. Many semiconductor fabrication tools include sophisticated fume exhaust systems which can lessen the effects of the carbon dioxide suppression agent, and therefore additional quantities of carbon dioxide suppression agent may need to be discharged into these tools to maintain an effective level of carbon dioxide concentration for the desired discharge time period. The tank 12 is sized to provide capacity for multiple operations of individual subsystems 24 prior to being refilled. Typically, it would not be necessary to have the refrigerated carbon dioxide tank 12 sized large enough to supply suppression agent to subsystems 24 associated with more than one or two tools as well as the inter-exposed tools within the clean room facility. However, minimum requirements will normally be indicated in published codes and standards. Selective operation of the selector flow control valves 22 enables this type of operation. If the system 10 is designed in this manner, it is likely that a carbon dioxide discharge cycle would not require the clean room facility to shut down entirely for a significant amount of time to evacuate carbon dioxide from the facility after a fire is suppressed. Although the concentration of carbon dioxide at or near the respective tool is significant during a discharge cycle, carbon dioxide levels in other areas of the facility are less significant. Therefore, the facility air handling equipment should normally be sufficient to dissipate carbon dioxide levels within the facility to levels that are safe for returning personnel relatively quickly.

Figure 3:
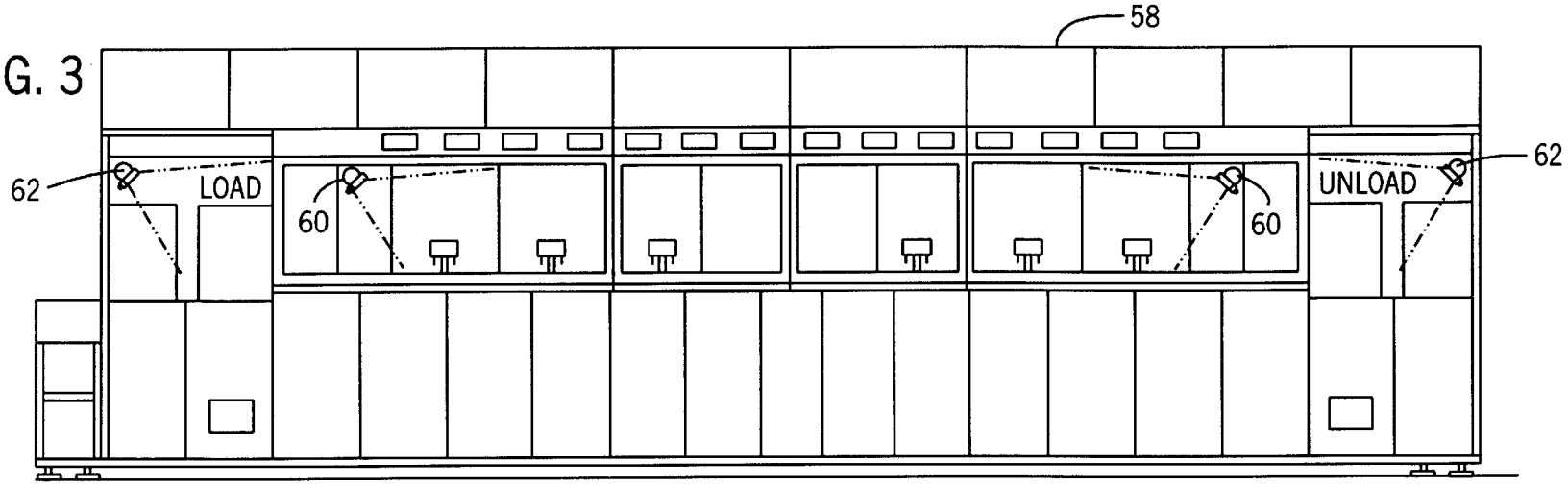
FIG. 3 is an elevational view of a representative semiconductor fabrication tool which illustrates the use of optical fire detectors.
Figure 4:
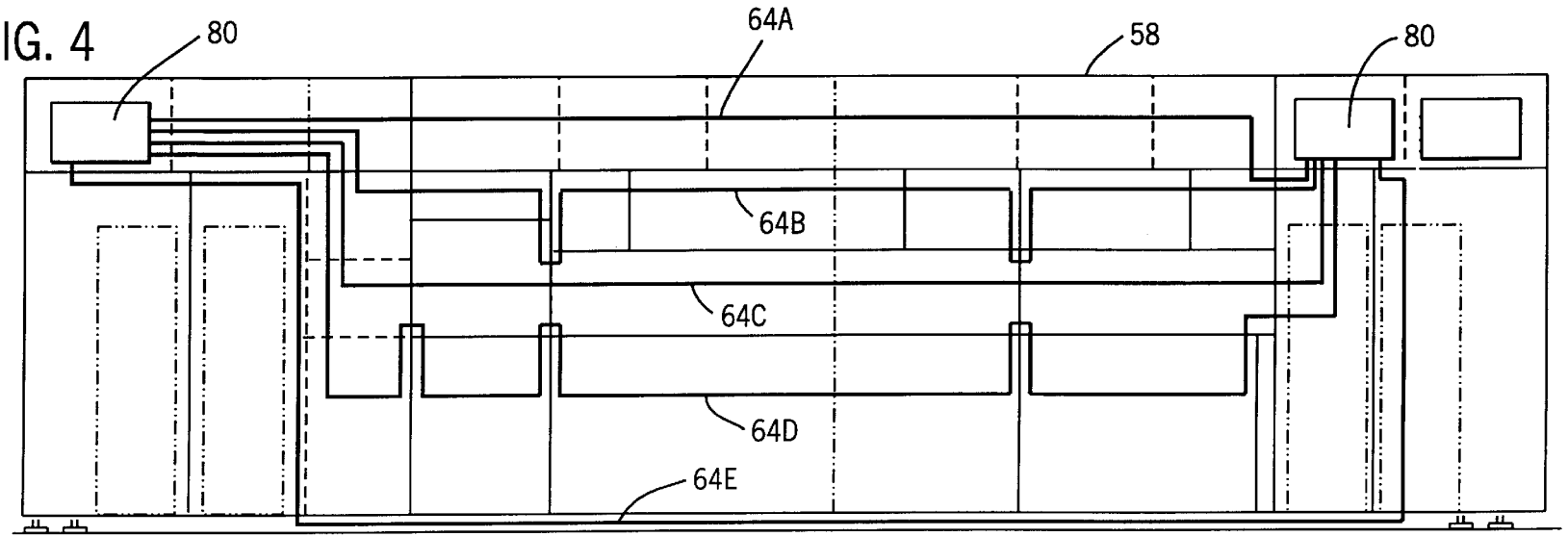
FIG. 4 is an elevational view of a semiconductor fabrication tool similar to FIG. 3 which illustrates the use of linear heat detection cable.

Referring now to FIGS. 3 and 4, each tool 58 preferably includes a plurality of optical fire detectors 60, 62, FIG. 3, and a plurality of linear heat detection cables 64*a*, 64*b*, 64*c*, 64*d*, and 64*e*, FIG. 4. As shown in FIG. 3, optical fire detectors 60 are mounted to view the process area of the tool 58, whereas optical fire detectors 62 are mounted to view the load station for the tool 58. The optical fire detectors 60, 62 are preferably infrared radiation fire detectors. Infrared radiation fire detectors are suitable in "stand-off" applications to detect the types of fires that normally occur in semiconductor fabrication tools. The IR fire detectors 60, 62 need to be mounted in an area of the tool that effectively monitors fire in the respective areas of the tool. Normally, this will require that the IR fire detector 60, 62 be mounted in a chemically corrosive environment of the tool 58. Therefore, it is important that the IR fire detectors 60, 62 be protected from corrosion. This is important not only to ensure the reliability of the IR fire detectors 60, 62, but also to prevent the formation of additional particulate matter which may pollute the clean room semiconductor fabrication process.

Figure 6:
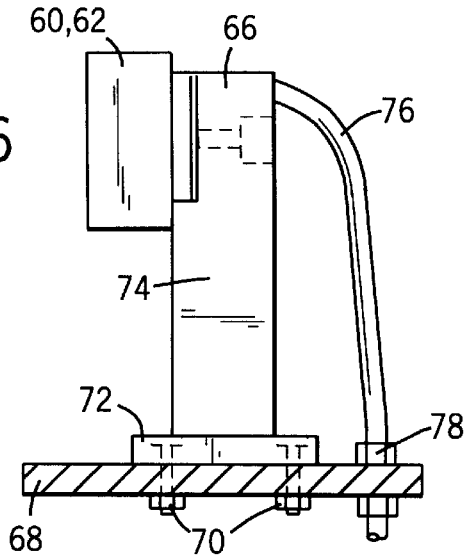
FIG. 6 is a detailed view showing an infrared radiation fire detector that is protected against chemical corrosion.

Referring to FIG. 6, the IR fire detectors 60, 62 are preferably mounted to a polypropylene mounting bracket 66 that is mounted to the frame 68 of the tool 58 via bolts 70. It is important that the mounting bracket 66 be made of a non-corrosive material such as polypropylene, however, other non-corrosive materials may be used in accordance with the invention. The mounting bracket 66 includes a base 72 and an elongated support arm 74 for the IR fire detector 60, 62. The cross-section of the base 72 is enlarged to facilitate secure mounting to the frame 68 of the tool 58. The elongated support arm 74 is useful to separate the IR fire detector 60, 62 from the frame 68 and therefore enhance the effective field of view of the detector 60, 62. A cable assembly 76 for the IR fire detector 60, 62 passes through the frame 68 via a penetration seal 78. The cable 76 is preferably covered with a Teflon jacket, or some other type of non-corrosive jacket to protect the cable 76 from corrosion.

Referring now to FIG. 4, it has been found to be advantageous to use a plurality of linear heat detection cables 64*a*, 64*b*, 64*c*, 64*d*, 64*e* routed through the tool 58 to detect fire in the areas of the tool 58 where it is not practical to use optical fire detectors 60, 62. Preferably, linear heat detection cable 64*a*, 64*b*, 64*c*, 64*d* and 64*e* is routed through each and every compartment of the tool 58 that is not monitored by optical fire detectors 60, 62. Many of the compartments through which the linear heat detection cables are routed are likely to be characterized as chemically corrosive environments. Therefore, it is preferred that each of the linear heat detection cables be protected from corrosion, such as a protective covering like a Teflon jacket or some other non-corrosive jacket which does not significantly affect the operation of the linear heat detection cables 64*a*, 64*b*, 64*c*, 64*d*, 64*e*. It is not necessary that the linear heat detection cable 64*a*, 64*b*, 64*c*, 64*d*, 64*e* be covered by a protected covering in portions of the tool 58 where the cable is routed through compartments that are not be characterized as chemically corrosive environments. The linear heat detection cable 64*a*, 64*b*, 64*c*, 64*d*, 64*e* terminate in termination cabinets 80 which include terminal strips for the respective linear heat detection cables. In addition, the cable assemblies 76 for the IR fire detectors 60, 62 also terminate in the termination cabinets 80. The control panel 36, FIGS. 1 and 11, communicates with the respective termination cabinets 80.

Figure 7:
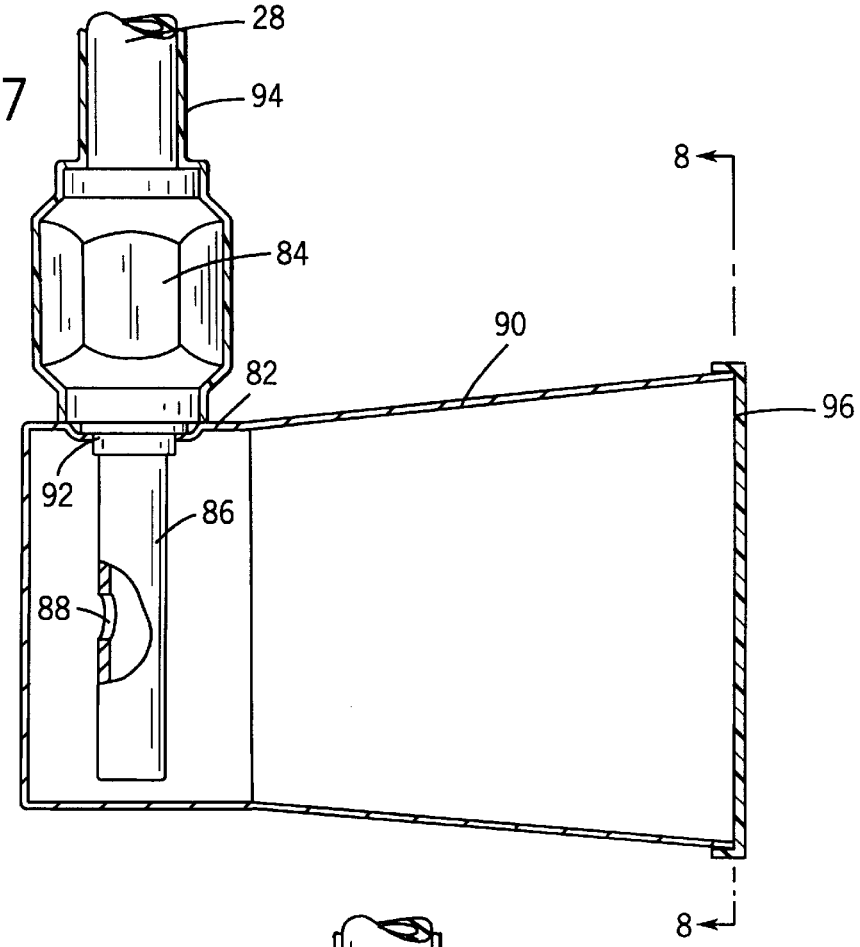
FIG. 7 is a side elevational view of a cone-type carbon dioxide discharge nozzle that is protected from chemical corrosion in accordance with the invention, and a corrosion resistant cap over the outlet of the discharge nozzle.
Figure 8:
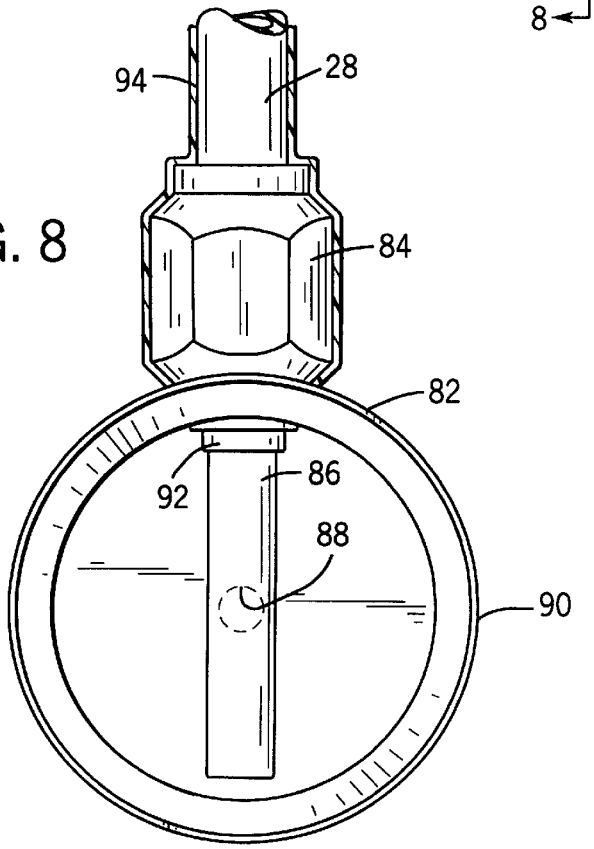
FIG. 8 is a view taken along line 8—8 in FIG. 7.

FIGS. 7–10 show two preferred types of carbon dioxide discharge nozzles used in accordance with the invention. Referring in particular to FIGS. 7 and 8, a cone-type carbon dioxide discharge nozzle 82 is used to provide carbon dioxide discharge at a reduced velocity in areas of the tool 58 where high volume, low velocity carbon dioxide discharge is necessary, such as electrically sensitive areas of the wet station within the tool 58. The reduced velocity of the cone-type discharge nozzle 82 produces a carbon dioxide cloud within the desired area. The cone-type discharge nozzles 82 are mounted to the subsystem discharge piping 28 using a fitting 84. The nozzle 82 includes a plenum 86 extending downward from a nozzle base 92. The plenum 86 has a rearward facing orifice 88. A corrosion resistant nozzle cone 90 is mounted to the nozzle base 92. The cone 90 is preferably a metal shell having an epoxy finish on its outer surface to protect the shell from corrosion. As previously mentioned, it is important that the manufacturing environment within and/or near the semiconductor fabrication tools be maintained ultra clean, especially in the etching and masking process areas. Since the various chemical compounds and acids in the process areas can chemically attack the surfaces of materials installed in the process areas, extensive measures must be taken to eliminate corrosion and the possibility of corrosion produced particulates from being introduced into the manufacturing process. With this in mind, the subsystem carbon dioxide distribution piping 28, which is preferably stainless steel, and the fitting 84 which is also preferably stainless steel are covered by a protective covering such as an outer jacket 94 of chemically inert "heat shrink" tubing. The preferred "heat shrink" tubing is clear to allow observation of the outer surface of the metal components 28, 84. The "heat shrink" tubing provides a continuous barrier around the metal materials conveying the carbon dioxide suppression agent. In addition, a blow-off cap 96 made of a corrosion resistant material, such as Teflon, is fit over the discharge outlet of the cone-shaped nozzle 90. The blow-off cap 96 prevents corrosive chemicals from entering the nozzle 82 and the associated subsystem distribution plumbing 28.

Figure 9:
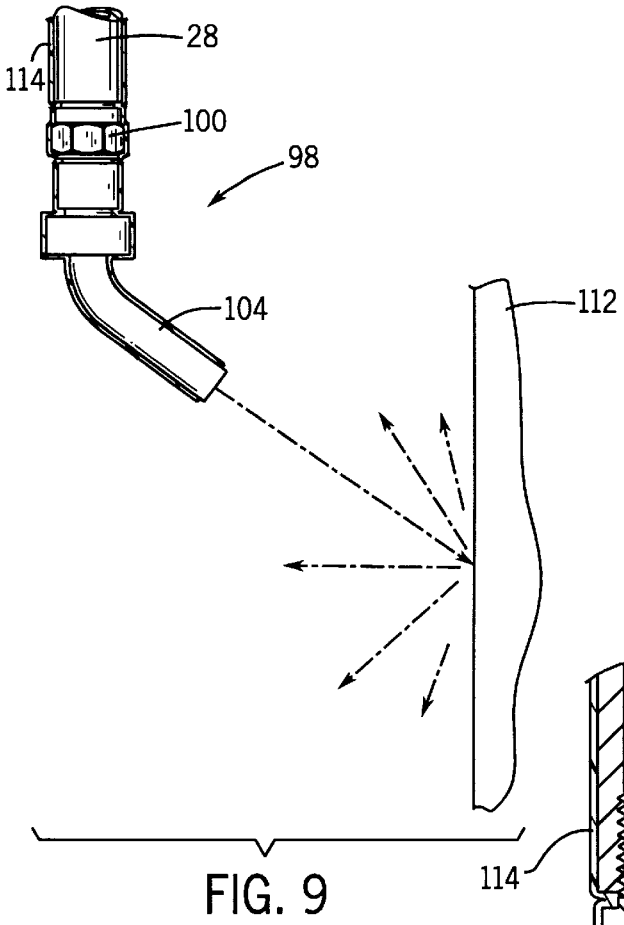
FIG. 9 is a schematic view illustrating the use of an orifice-type carbon dioxide discharge nozzle wherein the nozzle is protected against chemical corrosion in accordance with the invention.
Figure 10:
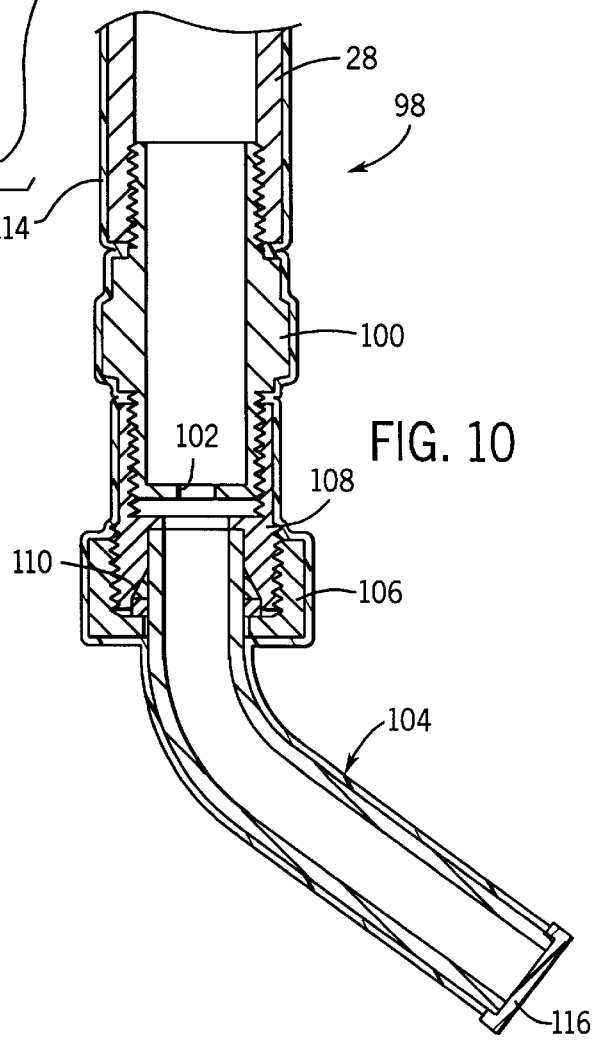
FIG. 10 is a sectional view of the orifice-type discharge nozzle shown in FIG. 9 which also illustrates the use of a corrosion resistant cap thereon.

Referring to FIGS. 9 and 10, spot-type orifice nozzles are used where relatively low volumes of carbon dioxide suppression agent are needed within or near the respective tool 58. The orifice-type nozzles 98 preferably include an orifice fitting 100 that is connected to the subsystem distribution piping 28. The orifice fitting 100 includes an orifice 102 at its discharge end. The size or the orifice 102 is selected to meter the proper amount of low pressure (e.g. 285–315 psig) carbon dioxide suppressant agent into the selected area. The orifice-type nozzles 98 also preferably include a spout 104 that directs the flow of low pressure carbon dioxide suppression agent from the orifice 102. The spout 104 includes a threaded fitting 106 at its upstream end which is connected to the orifice fitting 100 via threaded sleeve 108 and seal 110. As shown in FIG. 9, it is often desirable to direct the spout 104 so that discharging carbon dioxide suppressant agent bounces off a wall 112 of the tool 58 rather than directly on a critical process area. This type of configuration helps to disperse the carbon dioxide suppression agent without creating undue damage to process hardware and materials from the velocity of the discharging carbon dioxide.

For many of the reasons previously expressed, it is important to protect the elements of the nozzle 98 from corrosion. To this end, a protective covering 114, such as clear heat shrink tubing, is applied over the subsystem discharge piping 28 and the components 100, 108, 106, and 104 of the discharge nozzle 98. A corrosion resistant blow-off cap 116, preferably made of Teflon, is fit over the discharge outlet of the spout 104 to prevent corrosive chemicals from migrating internally through the nozzle 98 and into the associated subsystem discharge plumbing 28.

Figure 5:
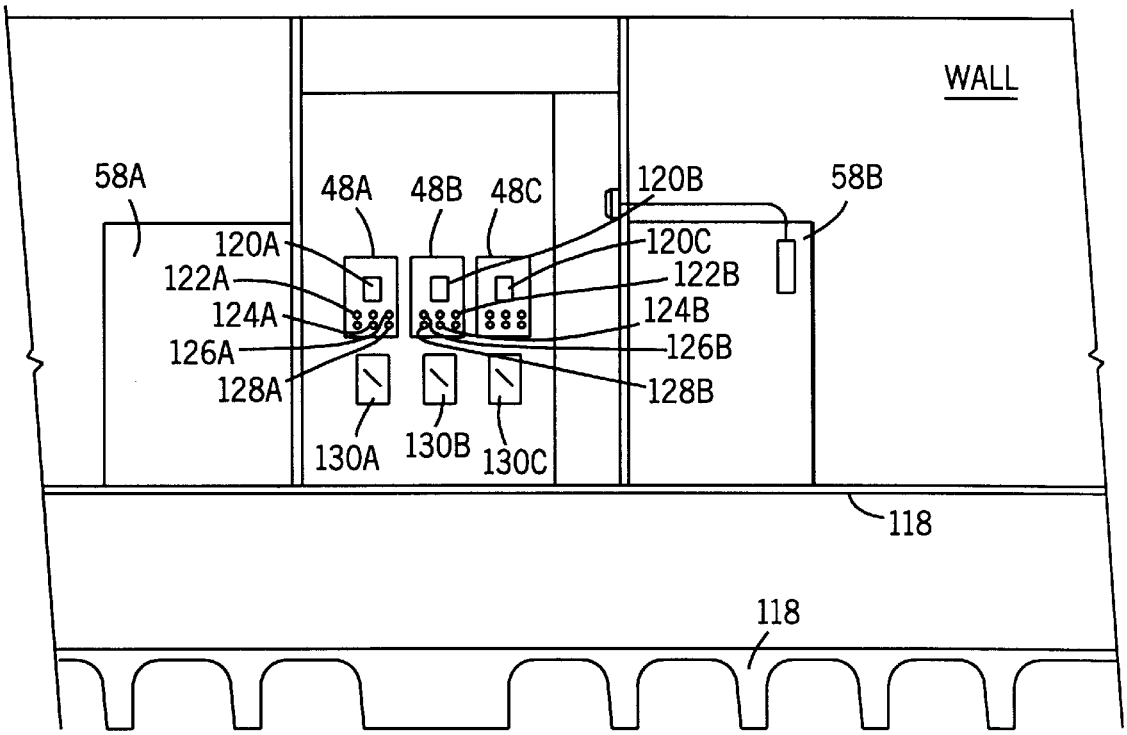
FIG. 5 is a schematic view illustrating the preferred placement of a user interface for the fire protection system in relation to semiconductor fabrication tools in a clean room facility.

FIG. 5 shows two inter-exposed semiconductor fabrication tools 58*a*, 58*b* installed in a clean room semiconductor fabrication facility. The tools 58*a*, 58*b* are placed on the floor 118 of the facility which may or may not be a waffle-type floor. A user interface panel 48*a*, 48*b*, 48*c* is provided near the respective semiconductor fabrication tools 58*a*, 58*b* (and 58*c* which is not shown). Each user interface 48*a*, 48*b*, 48*c* preferably includes an LCD display 120*a*, 120*b*, 120*c* that displays data relating to the fire protection system. Preferably, the display 120*a*, 120*b*, 120*c* displays data regarding the status of the control panel 36 which is located in a remote location from the tools 58*a*, 58*b*, 58*c*, such as underneath the floor 118. The user interfaces 48*a*, 48*b*, 48*c* also include two indicator lights 122*a*, 122*b*, two manual push-button stations 124*a*, 124*b*, a manual abort station 126*a*, 126*b* and an emergency shut-off station 128*a*, 128*b*. If desired, it is possible in accordance with the invention to include more or less indicators and/or manual actuation stations 124, 126, 128 at the user interface 48. In the preferred system, two fire protection subsystems are provided for each tool 58*a*, 58*b*.

The indicators 122*a*, 122*b* for the respective tool 58*a*, 58*b* preferably indicate fire detection status of IR detectors 60, 62, linear heat detection cables 64*a*, 64*b*, 64*c*, 64*d*, 64*e*, and smoke detectors 140. Each user interface 48*a*, 48*b* includes two manual actuation push-button stations 124*a*, 124*b*; one for each fire protection subsystem 24 associated with each tool 58*a*, 58*b*. It is preferred that the manual actuation stations override automatic fire detection control by the control panel 36. Once a discharge cycle is initiated manually in response to actuation of a manual push-button station 124*a*, 124*b*, the discharge cycle continues until completion, unless the operator actuates the emergency shut-off station 128.

As mentioned, each user interface 48*a*, 48*b*, 48*c* also includes an abort station 126*a*, 126*b* and an emergency shut-off station 128*a*, 128*b*. The abort station 126*a*, 126*b* has an actuation mechanism 127 (see FIG. 12) that is biased in an open condition so that an operator must apply physical force to the actuation mechanism 127 to suspend timer operation. The purpose of the abort station 126*a*, 126*b* is to momentarily suspend the operation of timer delay in the control panel 36 for the evacuation time period. Once the operator removes physical force from the actuation mechanism 127, the timer 40 continues to sequence towards the expiration of the evacuation time period (e.g. 30–45 second period prior to initiating carbon dioxide suppression agent through the system 10).

The subsystem emergency shut-off station 128*a*, 128*b* closes the selector valves 22 associated with the respective user interface 48*a*, 48*b* to terminate carbon dioxide discharge once the carbon dioxide discharge cycle begins, or possibly prevent a discharge cycle if actuated before it begins. Note that there is typically a certain amount of physical delay in the system after the evacuation time period before actual carbon dioxide discharge due to the amount of time required for the carbon dioxide suppressant agent to flow from the refrigerated tank 12 through the system distribution plumbing 20 and subsystem plumbing 28. Each user interface 48*a*, 48*b*, 48*c* is also provided with a mechanical operator 130*a*, 130*b*, 130*c* which is used to operate the respective subsystems 24 manually in case there is a power failure.

Figure 11:
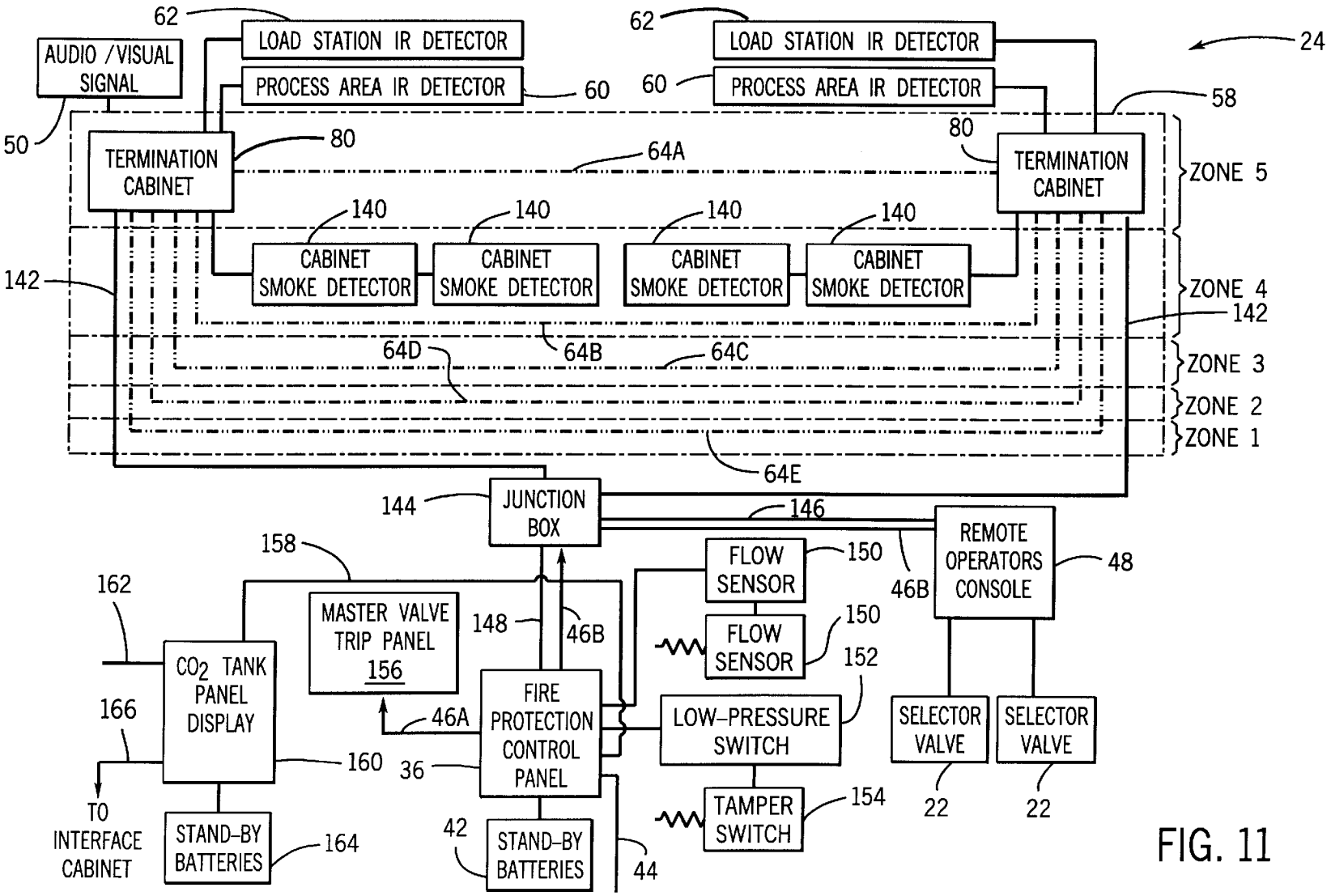
FIG. 11 is a schematic drawing illustrating the electrical connections for the electronic control system of the fire protection system.

FIG. 11 is a schematic drawing illustrating the electrical connections for one of the fire protection subsystems 24. In FIG. 11, the semiconductor fabrication tool 58 is separated into five fire detection zones. Linear heat detection cable is routed through each of the five zones to monitor for fire within each respective zone. As previously stated, the heat detection cable 64*a*, 64*b*, 64*c*, 64*d*, and 64*e* terminate in termination cabinets 80. If desired, smoke detectors 140 can be used in one or more of the zones to provide early detection of a fire. Normally, signals from the smoke detectors 140 are not used to initiate discharge of carbon dioxide suppression agent, but are merely used to provide an alert signal. Leads from the smoke detectors 140 also terminate in the termination cabinets 80. Likewise, leads from the IR radiation detectors 60, 62 terminate in the termination cabinets. The combination of the IR radiation detector 60, 62 and the linear heat detection cable 64*a*, 64*b*, 64*c*, 64*d*, 64*e* provide total fire detection for the complete tool 58 envelope. Cables 142 from the termination cabinets 80 are routed through junction box 144 to control panel 36. The termination cabinets 80 communicate electrically through line 148, 142 with the control panel 36. The user interface 48 communicates electrically with the control panel 36 through line 146, 148.

The control panel 36 receives signals from flow sensors 150 that monitor whether carbon dioxide suppression agent is flowing through the respective selector flow control valves 22. In addition, the control panel 36 receives signals from low pressure switches 152 and tamper switches 154 which supervise whether the respective flow control valves 18, 22 have vapor pilot line pressure available, switch 152, or whether the valve 53 has been tampered, switch 154. The control panel 36 outputs control signals through line 46*a* to a master valve trip panel 156 which is responsible for actuating the respective master flow control valve 18, and through line 46*b* to the user interface 48 to control the respective selector flow control valves 22. The control panel 36 also outputs information through line 158 to a display panel 160 located near the carbon dioxide tank 12. The display panel 160 receives electrical power via line 162 and back-up power from standby batteries 164. The fire protection subsystem 24 is electrically interfaced to the facility fire protection system by communicating through line 166. It should be noted that FIG. 11 shows the electrical flow of the system in a schematic manner and that the invention is not limited specifically to the manner shown in FIG. 11. Other electrical flow schemes should be apparent to those skilled in the art, and should be considered to fall within the scope of the invention.

Figure 12:
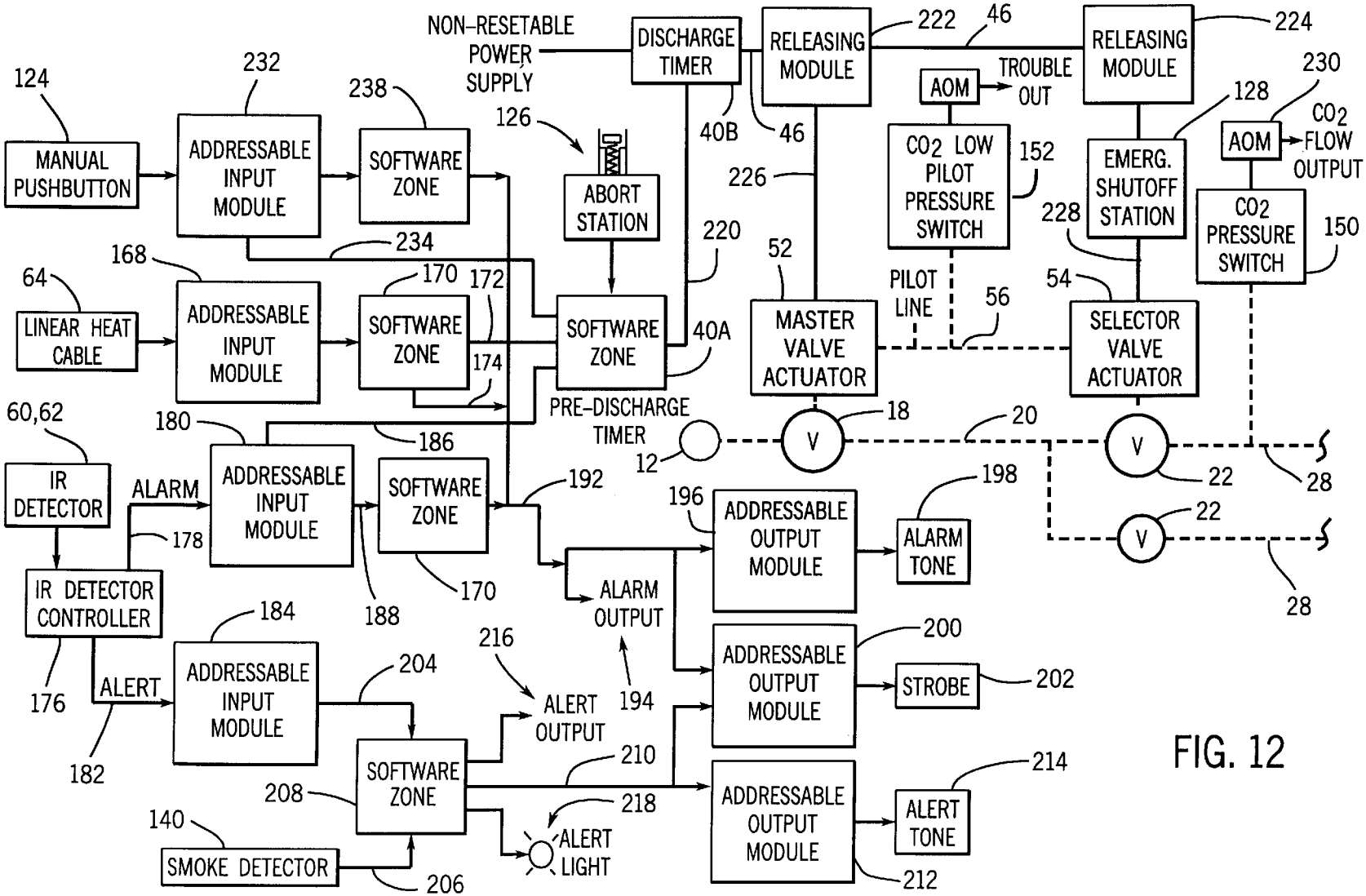
FIG. 12 is a logic diagram illustrating the preferred discharge timing sequence for a fire protection system in accordance with the invention.

FIG. 12 illustrates the preferred logic control for controlling the automatic discharge cycle of one of the fire protection subsystems 24 in the control panel 36. More specifically, the linear heat cable 64 is connected to an addressable input module 168 that communicates with a software zone 170 in the electronic control unit 38. Software zone 170 outputs an alarm signal through line 172 to software zone 40*a*, and an alarm signal through line 174. The alarm signal through line 172 is used to automatically initiate the control sequence for the carbon dioxide discharge cycle. The signal in line 174 initiates audible and/or visual alarms. The IR detectors in the system 60, 62 output a signal to an IR detector controller 176. The IR detector controller 176 outputs an alarm signal in line 178 to addressable input module 180 and an alert signal in line 182 to addressable input module 184. The addressable input module 180 outputs an alarm signal in line 186 to software zone 40*a*, and a signal through line 188 and software zone 190 to line 192 that is provided to the alarms in a manner similar to the signal in line 174 from software zone 170.

If an alarm signal is present in lines 174 or 192, the alarm signal is output to the general fire protection system for the entire facility, reference number 194. When an alarm signal is present in 192 or 174, it is also transmitted to an addressable output module 196 that initiates an audible alarm 198 at an alarm tone, and an addressable output module 200 that initiates a strobe 202. Thus, personnel in the clean room are provided an immediate audio signal that fire has been detected. When an alert signal is present in line 204 from the addressable input module 184 or line 206 from the smoke detector 140, software zone 208 outputs an alert signal in line 210. When an alert signal is present in line 210, the signal is transmitted to addressable output module 200 to activate the strobe 202 and is also transmitted to addressable output module 212 to initiate the operation of an audible signal at an alert tone which is in general different than the alarm tone of block 198. The purpose of the alert is to alert personnel that an alarm situation is possibly imminent. When an alert signal is present in either lines 204 or 206, software zone 208 also outputs an alert output signal, reference number 216 to the general fire protection system for the entire facility, and an alert signal to initiate the illumination of an alert light 218, located at user interface 48.

When an alarm signal is present in line 186 or 172, software zone 40*a* initiates the sequencing of a preselected evacuation time period (e.g. 30–40 seconds) which provides a sufficient time delay for personnel to evacuate from the immediate vicinity of the tool 58*b* upon hearing the alarm 198. Actuation of the subsystem abort station 126 momentarily suspends the sequencing of the evacuation time period. As previously noted, the abort station 126 has an actuating mechanism 127 that is biased in an open condition so that an operator must apply physical force to the actuation mechanism 127 in order to suspend timer operation and delay the expiration of the evacuation time period. Upon expiration of the evacuation time period, a signal is output from software zone 40*a* to discharge timer 40*b* via line 220. The discharge timer 40*b* receives power from a non-resettable power supply. Upon receiving a signal through line 220, the discharge timer 40*b* outputs control signals through lines 46 to releasing modules 222, 224 for the respective valve actuators 52, 54. Releasing module 222 sends a signal to actuator 52 through line 226 which allows the vapor pressure in pilot line 56 to open the master flow control valve 18. Releasing module 224 outputs a signal through line 228 to selector valve actuator 54. Emergency shut-off station 128 is hardwired into the line 228. The emergency shut-off station 128 is normally closed and, absent operator intervention to open the emergency shut-off 128, the control signal from the releasing module 224 travels through line 228 to the selector valve actuator 54 uninterrupted. Upon receiving a signal through line 228, the selector valve actuator 54 is actuated by the vapor pressure in the pilot line 56 to open the selector flow control valve 22. With master valve 18 and selector flow control valve 22 open, carbon dioxide suppressant agent is able to discharge from the refrigerated tank 12 through the distribution plumbing 20 and the subsystem plumbing 28 into the respective tool 58. Carbon dioxide pressure switch 150 monitors the presence of carbon dioxide suppression agent downstream of the selector flow control valve 22, and the addressable output module 230 outputs a signal to the control panel 36 if flow is present. Carbon dioxide suppression agent continues to discharge automatically for the discharge cycle time period (e.g. approximately 45–60 seconds) which is preselected by the discharge timer 40*b*, unless the emergency shut-off station 128 is actuated. If the emergency shut-off station is actuated, the associated selector flow control valve 22 is closed to terminate carbon dioxide discharge before the expiration of the preselected carbon dioxide discharge time period.

Subsystem discharge can also be initiated manually by actuating a manual push-button 124 at the user interface 48. When the manual push-button 124 is actuated, an addressable input module 232 outputs an alarm signal in line 234 to software zone 40*a* which initiates a discharge cycle even if an alarm signal is not present in lines 172 or 186, and also outputs an alarm signal to software zone 238 which outputs a signal in line 240 for the alarm functions as previously described with respect to lines 192 and 174.

It should be appreciated to those skilled in the art that the invention has been explained herein in conjunction with a preferred embodiment of the invention, and that various modifications and alternatives can be implemented without departing from the true spirit of the invention. The following claims should be interpreted to include such modifications, alternatives or equivalents.

I claim:

1. A method of operating a fire detection and low pressure carbon dioxide fire suppression system in a semiconductor fabrication facility having a plurality of semiconductor fabrication tools, the method comprising the steps of:

providing a source of low pressure carbon dioxide;

providing at least one fire protection subsystem for each semiconductor fabrication tool that detects fire within the respective tool and subsequently discharges low pressure carbon dioxide within the tool to suppress fire detected within the tool, wherein each subsystem includes a user interface panel located at the tool and having an actuation station with a manual actuation switch, an abort station with a manual actuating mechanism, and an emergency shut-off station with a manual shut-off mechanism; and controlling the discharge of low pressure carbon dioxide by the fire protection subsystem in accordance with the following steps:

a) starting a timer set for a time delay sufficient for evacuation of personnel from the immediate vicinity of the tool upon receiving an alarm signal from a detector monitoring the semiconductor fabrication tool for fire;

b) momentarily suspending the operation of the timer to selectively delay the expiration of the evacuation time period in response to manual actuation of the subsystem abort station actuating mechanism;

c) upon expiration of the evacuation time delay, automatically energizing one or more actuators to allow one or more associated selector flow control valves located in the plumbing between the source of low pressure carbon dioxide and the subsystem discharge plumbing to open for a preselected carbon dioxide discharge time period;

d) selectively closing the one or more selector flow control valves to terminate carbon dioxide discharge before expiration of the preselected carbon dioxide discharge time period in response to manual actuation of the subsystem emergency shut-off mechanism; and e) automatically closing the one or more flow control valves between the source of low pressure carbon dioxide and the subsystem discharge plumbing upon expiration of the preselected carbon dioxide discharge time period.

2. The invention as recited in claim 1 wherein the source of low pressure carbon dioxide consists of a refrigerated tank containing carbon dioxide liquid in which the vapor pressure in the tank is normally maintained between 285–315 psig.

3. The invention as recited in claim 1 wherein the actuating mechanism for the abort station has an open condition in which the abort station does not affect operation of the timer for the evacuation time period and a closed position in which the abort station suspends operation of the timer, and the actuating mechanism is biased in the open condition so that an operator of the subsystem must apply physical force to the actuation mechanism to suspend timer operation and delay expiration of the evacuation time period.

4. In a semiconductor fabrication facility having a plurality of semiconductor fabrication tools, a fire detection and low pressure carbon dioxide fire suppression system comprising:

a source of low pressure carbon dioxide;

at least one fire protection subsystem for each semiconductor fabrication tool that detects fire within the respective tool and subsequently discharges low pressure carbon dioxide within the tool to suppress fire detected within the tool, the fire protection subsystem including:

a plurality of detectors located within the respective tool each outputting an alarm signal when a fire is detected by the respective detector, subsystem low pressure carbon dioxide discharge plumbing which includes discharge piping routed through the tool, a plurality of discharge nozzles mounted to the discharge piping, and a selector flow control valve that controls the flow of low pressure carbon dioxide to the discharge piping, an enclosed control panel physically located in a region remote from the tool associated with the respective fire protection subsystem, said control panel including an electronic controller, a timer and a back-up power supply, wherein the control panel receives external electrical power and outputs electrical power to the detectors for the subsystem, and wherein the control panel also receives signals from the detectors for the subsystem and outputs control signals which are used to control automatic actuation of the selector flow control valve in response to the one or more alarm signals from one or more of the detectors associated with the subsystem to initiate a carbon dioxide discharge cycle for suppressing fire detected in the semiconductor fabrication tool, and a user interface panel located at the tool associated with the respective subsystem, the user interface panel including a manual subsystem actuating switch, a manual abort actuation mechanism, and a manual emergency shut-off mechanism; and low pressure carbon dioxide distribution plumbing that distributes low pressure carbon dioxide from the source of low pressure carbon dioxide to the selector flow control valve for the fire protection subsystem;

wherein the selector flow control valve opens at the expiration of an evacuation time period and automatically closes upon termination of the carbon dioxide discharge cycle, manual actuation of the subsystem actuation switch on the user interface panel initiates the discharge cycle, actuation of the abort actuating mechanism on the user interface panel momentarily suspends the sequencing of the evacuation time period to selectively delay the expiration of the evacuation time period, and manual actuation of the emergency shut-off mechanism on the user interface panel closes the selector flow control valve when actuated.

5. A fire detection and low pressure carbon dioxide fire suppression system as recited in claim 4 wherein the source of low pressure carbon dioxide consists of a refrigerated tank containing carbon dioxide liquid in which the vapor pressure in the tank is normally maintained between 285–315 psig.

6. A fire detection and low pressure carbon dioxide fire suppression system as recited in claim 4 wherein the user interface also includes a display which mimics information output on a display for the control panel.

7. A fire detection and low pressure carbon dioxide fire suppression system as recited in claim 4 wherein:

the subsystem includes an annunciator located near the semiconductor fabrication tool and one or more of the detectors provides an alert signal upon detecting fire characteristics at a threshold which is below the threshold for outputting an alarm signal; and the control panel actuates the annunciator upon receiving an alert signal from one of the detectors.

8. A fire detection and low pressure carbon dioxide fire suppression system as recited in claim 4 wherein the low pressure carbon dioxide distribution plumbing includes:

a tank discharge header mounted to the tank;

a master flow control valve that controls flow through the tank discharge header;

a distribution pipe from the tank discharge header to a plurality of selector flow control valves associated with the recited master flow control valve wherein the control panel outputs a control signal to open the associated master flow control valve in response to the one or more alarm signals from the one or more detectors in the respective fire protection subsystem.

9. A fire detection and low pressure carbon dioxide fire suppression system as recited in claim 8 wherein:

the tank discharge header is a manifold having a plurality of outlets; and a plurality of master flow control valves are provided, a separate master flow control valve controlling flow through each of the outlets of the manifold.

10. A fire detection and low pressure carbon dioxide fire suppression system as recited in claim 4 wherein each selector flow control valve is opened and closed by an electrically controlled actuator, each actuator being connected to a vapor pressure pilot line from the low pressure carbon dioxide source to provide actuation pressure for the respective flow control valve.

11. A fire detection and low pressure carbon dioxide fire suppression system as recited in claim 4 wherein each discharge nozzle has a discharge outlet, and each discharge nozzle is located in a chemically corrosive environment within one of the respective semiconductor fabrication tools and includes a corrosion resistant protective cap covering its discharge outlet.

* * * * *